US008403164B2

(12) United States Patent
Samson

(10) Patent No.: US 8,403,164 B2
(45) Date of Patent: Mar. 26, 2013

(54) CAP FOR A SPILL-PROOF BEVERAGE CONTAINER

(76) Inventor: Ilan Samson, London (GB)

( * ) Notice: Subject to any disclaimer, the term of this patent is extended or adjusted under 35 U.S.C. 154(b) by 693 days.

(21) Appl. No.: 12/595,645

(22) PCT Filed: Apr. 9, 2008

(86) PCT No.: PCT/GB2008/050249

§ 371 (c)(1),
(2), (4) Date: Oct. 13, 2009

(87) PCT Pub. No.: WO2008/125877

PCT Pub. Date: Oct. 23, 2008

(65) Prior Publication Data

US 2010/0044386 A1 Feb. 25, 2010

(30) Foreign Application Priority Data

Apr. 13, 2007 (GB) ..... 0707156.6

(51) Int. Cl.
*B65D 51/16* (2006.01)

(52) U.S. Cl. ..... 220/203.19; 220/713; 220/714; 220/717; 215/11.4; 215/11.5; 215/387; 206/217

(58) Field of Classification Search ..... 220/719, 220/714, 717, 713, 203.18, 203.09, 203.19; 215/11.4, 11.5, 309, 387; 137/286; 206/217
See application file for complete search history.

(56) References Cited

U.S. PATENT DOCUMENTS 3,493,011 A 2/1970 Caruso
5,409,035 A 4/1995 Scott et al.
6,554,023 B2 4/2003 Danby et al.
(Continued)

FOREIGN PATENT DOCUMENTS

WO WO03068036 8/2003

OTHER PUBLICATIONS

International Search report for PCT/GB2008/050249 dated Jul. 11, 2008.

(Continued)

*Primary Examiner* — Mickey Yu
*Assistant Examiner* — Kareen Rush
(74) *Attorney, Agent, or Firm* — Dvorah Graeser; Graeser Associates International Inc

(57) ABSTRACT

A cap is described for closing a liquid beverage container for allowing the beverage to be sucked out of the container through a spout, while preventing spillage when no suction takes place. A demand valve is incorporated into the cap, which has an inlet port communicating with the interior of the container, a discharge port communicating with the spout and a control port communicating with the ambient atmosphere through a hole in the cap. The valve has a valve seat and a closure element controlling the flow from the inlet port to the discharge port urged to move into an opening position in dependence on the excess of the control pressures over that in the discharge ports, this movement being in the direction opposed to the flow and urged by the pressure in the container in a direction to seal against the valve seat. In the invention, the demand valve is formed by two members that are mounted on the inner surface of the cap. The first member is rigid and defines the valve inlet port and the valve seat. The second member incorporates the valve closure element and a resilient membrane which includes the valve closure element and serves as a pressure sensitive diaphragm. The second member also seals against the first member, around the hole in the cap and around the spout.

16 Claims, 1 Drawing Sheet

U.S. PATENT DOCUMENTS

| | | | | |
|---|---|---|---|---|
| 7,204,386 | B2 * | 4/2007 | Hakim | 220/714 |
| 2002/0189683 | A1 | 12/2002 | Danby | |
| 2003/0098312 | A1 * | 5/2003 | Hakim | 220/714 |
| 2003/0209555 | A1 * | 11/2003 | Belcastro | 220/714 |
| 2004/0011800 | A1 | 1/2004 | Essebaggers | |
| 2006/0151499 | A1 * | 7/2006 | Lieberman et al. | 220/203.11 |
| 2008/0128438 | A1 * | 6/2008 | Lane | 220/717 |
| 2009/0020544 | A1 * | 1/2009 | Yuen | 220/714 |
| 2010/0147862 | A1 * | 6/2010 | Keefe et al. | 220/714 |
| 2010/0270322 | A1 * | 10/2010 | Lieberman et al. | 220/714 |
| 2011/0079601 | A1 * | 4/2011 | Steininger | 220/714 |

OTHER PUBLICATIONS

Written Opinion of the Internation Search Authority for PCT/GB2008/050249 dated Jul. 11, 2008.

* cited by examiner

CAP FOR A SPILL-PROOF BEVERAGE CONTAINER

This Application is a national phase of, and claims priority from, PCT Application No. PCT/GB2008/050249, filed on Apr. 9, 2008, which claims priority from United Kingdom Application No. GB 0707156.6, filed on Apr. 13 2007, all of which are hereby incorporated by reference as if fully set forth herein.

FIELD OF THE INVENTION

The present invention relates to a cap for a spill-proof beverage container and to such a cap when fitted releasable or permanently to a beverage container.

BACKGROUND OF THE INVENTION

The need for spill-proof cups, as used by infants and the infirm, is well known. These cups are liquid-tight, preferably also air-tight, and are designed not to leak when the cup is held in a tilted or overturned position by a child, or when the cup falls on its side or even turns over. Preferably, the cup should also resist spillage when shaken or swung, as happens when children carry it around carelessly.

There are various known designs serving this purpose. A first design requires some deliberate action to be taken to seal and/or open the cups and such cups suffer from the obvious disadvantage that an infant cannot be relied on to operate the closure. A second design includes a pressure operated valve that is intended to open automatically in response to a reduced pressure in the spout, and to reseal when the suction is removed. Such valves suffer from the general problem that they cannot distinguish between high pressure within the container and low pressure in the spout. Therefore these valves are either not efficient in blocking leaks, or else they offer an undesirable level of resistance to suction.

A still further problem with cups having pressure operated valves is that they cannot safely be used with carbonated or hot beverages. In the latter case, when the cup is inverted the liquid heats the air in the ullage space and increases the pressure within the container because the outlet is already covered by the liquid, which is then driven out.

To avoid the above disadvantages, the present invention uses a valve known as a self-sealing demand valve, the self-sealing referring to the fact that the pressure inside the container acts to close the valve rather than to open it. Another advantage of such a valve is that it can be designed in a way that allows the valve to be opened by a very low suction level A simple general way to implement a self-sealing demand valve is by constructing the valve such that the valve closure element moves against the direction of fluid flow when opening the valve. Examples of this kind of valve are to be found in U.S. Pat. Nos. 5,409,035, 3,493,011 and 6,554,023. The valve contains a diaphragm that is subjected on a first side to a fixed pressure, usually atmospheric, and acts on its second side on a valve closure element. The valve closure element is biased towards a closed position in which it seals against a valve seat. The pressure on the outlet side of the cup acts on the second side of the diaphragm so that, when suction is applied to the outlet, the diaphragm forces the valve closure element in a direction to lift the closure element off its seat and open the valve. In the absence of suction at the outlet, the biasing force of the valve closure element returns it to the closed position and keeps it closed, and any positive pressure at the valve inlet increases the closing force.

Valves of this nature have not yet been applied to mass-market spill-proof cups for use by infants because of certain requirements that need to be met. In particular, it is important for all the following criteria to be met, namely:

- all sides of all components need to be easily accessible for thorough cleaning,
- the diaphragm, when installed, needs to be exposed to outside atmospheric pressure but must not be accessible to accidental contact from outside the cup,
- the number of separate components needs to be minimised and their forms must be designed so as to minimise manufacturing cost and to ease handling,
- the disassembly for cleaning must be easy to perform and it should only be possible to reassemble the components in one way, and
- for safety reason, components smaller than a specified minimum size must not be used.

Packaging of a demand valve within a spill-proof cup also presents difficulties in that the volume between the valve and the spout of the cup needs to be kept to a minimum. This volume will, after drinking, remain filled with liquid and may subsequently run out or shake out. It has been proposed in the prior art to interpose a small orifice but this would make it more difficult to drink from the cup. It would also adversely affect the ease with which the valve components can be moulded and cleaned.

WO03/068036, which is believed to represent the closest prior art to the present invention, discloses a cap for closing a liquid beverage container for allowing the beverage to be sucked out of the container through a spout, while preventing spillage when no suction takes place. A demand valve is incorporated into the cap, the demand valve having an inlet port communicating with the interior of the container, a discharge port communicating with the spout and a control port communicating with the ambient atmosphere through a hole in the cap. The valve has a valve seat and a closure element controlling the flow from the inlet port to the discharge port, the closure element being urged by the pressure in the container in a direction to seal against the valve seat and being urged to move to an open position in dependence on the excess of the pressure in the control port over that in the discharge port. The movement of the closure element to open the valve is in the opposite direction to that of the flow of liquid through the valve. The demand valve is formed by two members that are mounted within the spout of the cap. The first member is rigid and defines the valve inlet port and the valve seat. The second member incorporates the valve closure element and a resilient membrane which serves as a pressure sensitive diaphragm, the second member sealing against the first member and around the hole in the cap.

The spill-proof cup of the latter patent specification could not be made to operate satisfactorily and has not been marketed. Because of a feature inherent in its design, the second member of the demand valve could not be made to seal reliably against the first member.

OBJECT OF THE INVENTION

The present invention seeks therefore to provide a cap for a spill-proof cup which incorporates a demand valve and in which a reliable seal is achieved between the rigid and flexible members constituting the demand valve.

SUMMARY OF THE INVENTION

According to the present invention, there is provided a cap for closing a liquid beverage container for allowing the beverage to be sucked out of the container through a spout, while preventing spillage when no suction takes place, wherein a demand valve is incorporated into the cap, the demand valve having an inlet port communicating with the interior of the container, a discharge port communicating with the spout and a control port communicating with the ambient atmosphere through a hole in the cap, the valve having a valve seat and a closure element controlling the flow from the inlet port to the discharge port, the closure element being urged by the pressure in the container in a direction to seal against the valve seat and being urged to move to an open position in dependence on the excess of the pressure in the control port over that in the discharge port, the movement of the closure element to open the valve being in the opposite direction to that of the flow of liquid through the valve, wherein the demand valve is formed by two members that are mounted on the inner surface of the cap, the first member being rigid and defining the valve inlet port and the valve seat and the second member incorporating the valve closure element and a resilient membrane which is connected to the valve closure element and serves as a pressure sensitive diaphragm, the second member sealing against the first member and around the hole in the cap, characterised in that the second member surrounds and seals against the entire outer rim of the first member.

The resilient member in WO03/068036 needs to make sealing contact with both a front face and a rear face of the rigid member. The line of sealing contact follows only part of the outer rim of the rigid member on one side. The line of contact then crosses over the rim of the rigid member and onto its opposite side. In practice, such a seal is difficult (if not impossible) to achieve, especially in a valve that is designed to be taken apart and reassembled for cleaning.

In a preferred embodiment of the present invention, the resilient member also seals around an extension of the spout.

The cap of the invention is primarily intended for fitting to the rim of drinking cup but it may alternatively be fitted to a bottle or even a plastics bag. Furthermore, it is an important advantage that the first and second members may be releasable from the cap for cleaning and sterilisation allowing the cap or drinking container to be reused but the cap may alternatively form part of a disposable container and in such an application there is no need for the first and second members to be releasable from the cap.

Preferably, the second member is trapped between the cap and the first member.

Biasing means are preferably provided to urge the closure element towards the closed position. Once the closure member is in contact with the valve seat, no remaining biasing force is needed to keep it closed in any orientation. This is because it needs to be closed only when inversion or partial inversion would allow the contained liquid to exit and under such conditions the surface tension of the liquid acting between the valve seat and the closure element would keep the valve closed. Once the liquid in the cup rests on the closure element, no other force is needed to hold it closed in an essentially static situation or under mild movement. A very small additional biasing force is desirable only in order to withstand vigorous shaking of an inverted or partially inverted cup.

The volume between the valve seat and the outlet must be minimal, thus requiring the space between the diaphragm and the first member to be minimised. This space needs to accommodate the movement of the diaphragm as it is drawn towards the first member by the suction from the outlet, at which time it is deformed into a generally shallow bowl shape. The net force pulling the diaphragm results from the suction acting on only the annular area between the diaphragm diameter and the valve-seat diameter (the latter needs to be large enough to allow adequate flow), so the first member should be shaped so that liquid trapped between it and the diaphragm in the annular section and its surface tension does not further reduce the effective net area that is subjected to the suction. For that purpose the generally conically dished upper surface of the first member is preferably provided with a steeply inclined lip around its periphery so that the surface is slightly recessed below a thin rim.

BRIEF DESCRIPTION OF THE DRAWINGS

The invention will now be described further, by way of example, with reference to the accompanying drawings, in which.

DETAILED DESCRIPTION OF THE PREFERRED EMBODIMENT(S)

Figure 1:
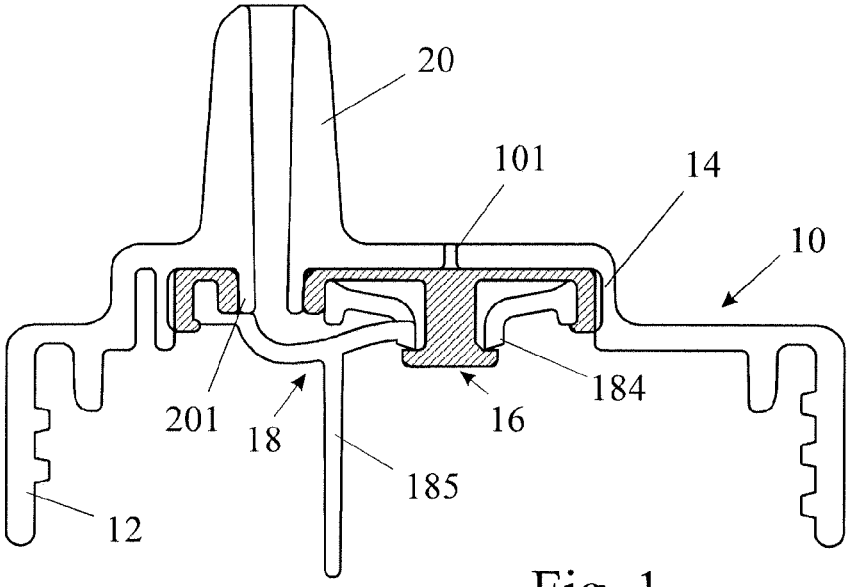
FIG. 1 is a section through the cap of a spill-proof cup of the invention with the demand valve in its assembled and closed state.

Throughout the description, when referring to directions such as downwardly, it is assumed that the cup is in the position shown in FIG. 1 in which the base of the cup is resting on a horizontal surface and the cap is uppermost.

FIG. 1 shows only the cap 10 of a spill-proof drinking cup having an internally threaded rim 12 so that it may be screwed onto the cup (not shown). The cap incorporates an oval recess 14 for receiving two members 16 and 18 which constitute a demand valve. A spout 20, formed preferably integrally with the cap 10, opens into the recess 14.

The member 16 is made of a resilient material while the member 18 and the cap 10 are rigid, although they might contain soft or resilient sections. To allow the three components 10, 16 and 18 to be readily distinguished from one another, only the resilient member 16 has been cross hatched in the section of FIG. 1. The three components of the valve are separable from one another, so that they may be cleaned, and are assembled by first fitting the resilient member 16 over the rigid member 18, then inserting the two members 16 and 18 together into the recess 14 in the cap where they are retained by compression of the rim of the resilient member 16 between the rigid member 18 and the cap. At the same time, the sealing ring 163 is retained by compression between spout extension 201 and chamber 181.

Figure 3:
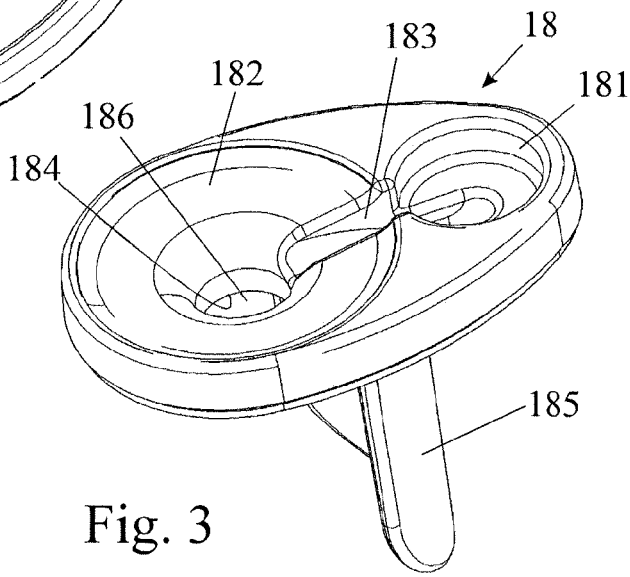
FIG. 3 is a perspective view from above of the rigid member of the demand valve.

As shown in FIG. 3, the rigid member 18 defines two chambers 181 and 182, interconnected by a channel 183. When the valve is assembled, the chamber 181 is in sealing communication with the spout 20 and the chamber 182 is generally funnel shaped and communicates with the interior of the cup through an opening 186 surrounded by a valve seat 184. The channel 183 allows the pressure in the chamber 182 to be reduced by sucking on the spout 20 and also allows liquid from the cup to flow to the spout 20.

A cylindrically curved handle 185 that can easily be gripped between the thumb and index finger of one hand projects from the underside of the member 18. This allows the member 18 to be held still while the resilient member 16 is fitted over it, or peeled off it, and allows the rigid member 18 to be pushed into and pulled out of the recess 14 in the cap 10.

The resilient member 16 has a downwardly directed rim 161 that surrounds the entire periphery of the rim of the rigid member 18. This configuration ensures that an effective seal is achieved between the resilient member 16 and the rigid member 18.

Within the area surrounded by the rim 161, the resilient member 16 has a hole 162 surrounded by a downwardly protruding sealing ring 163 that surrounds and seals against a short inwardly projecting tubular extension 201 of the spout 10. When the demand valve is assembled, the sealing ring 163 sits within the chamber 181 and is compressed between the inner wall of the chamber 181 and the tubular extension 201 to effect a seal that allows fluid communication between the spout 20 and only the lower face (as viewed in FIG. 1) of the resilient member 16.

The resilient member 16 also has a downwardly projecting mushroom-shaped valve closure member 164 dimensioned such that it can be pushed through and pulled out of the hole 186 in the rigid member 18. Because of its resilience, the area of the member 18 overlying the chamber 182 of the rigid member acts as a diaphragm which pulls up on the closure element to keep it in sealing contact with the valve seat 184 surrounding the hole 184. A small hole 101 is formed in the cap above the diaphragm to allow atmospheric pressure to act on the upper face of the resilient member 16.

To prevent the creation of a vacuum within the cup as a beverage is sucked out of it through the spout 10, it is necessary to provide a vent to allow air to enter into the cup. Of course, liquid should not be allowed to escape from the cup through this vent and for this reason it is common to use a one way valve. A known form of such a valve is a sphincter valve which comprises a convex resilient surface divided by one or more slits into two or more petals which separate to allow air to pass through in one direction but are squeezed to seal against one another to prevent passage of liquid in the opposite direction.

Figure 2:
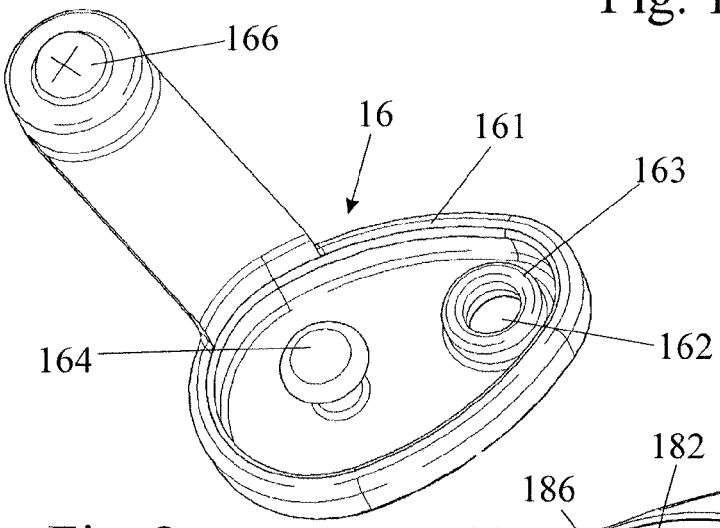
FIG. 2 is a perspective view from below of the resilient member of the demand valve.

FIG. 2 shows such a sphincter valve 166 formed integrally with the resilient member at the end of a laterally projecting arm 167. The valve 166 fits over a short tube that projects from the cap into the interior of the cup but neither the tube nor the sphincter valve 166 appears in the section of FIG. 1.

When not in use, the components of the demand valve adopt the position shown in FIG. 1. Here, the head of the mushroom 16 seals against the valve seat 184 to prevent liquid from escaping from the interior of the cup through the spout. The valve seat 184 is not flat but slightly conical with its apex pointing downwards so that a line contact is achieved between the closure element 164 and the valve seat 184. Aside from improving the sealing around the valve seat, this shaping of the apex reduces the venturi (Bernoulli) effect. At this time, the diaphragm portion of the resilient member 16 may be in a fully relaxed state or it may be slightly deflected from its relaxed state to apply a resilient biasing force to the closure element 164.

If the cup is inverted, the pressure acting on the head valve closure 164 urges it more strongly against the valve seat and this effect is further assisted by the surface tension of the liquid between the closure element 164 the conical valve seat 184. The seal is therefore capable of withstanding not only inversion of the cup but shaking and even high pressure build-up within the cup, as may occur with carbonated beverages and hot beverages.

To provide the seal between the closure element 164 and the valve seat 184 when the valve is not in use, the natural resilience of the member 16 may, if desired, be replaced or supplemented by magnetism. For example, the resilient member 16 may be made of a material loaded with a magnetic or ferrous powder and a magnet may be moulded into the cap 10 or into the first member. Other forms of biasing may alternatively be used. For example, a spring may be used, and such a spring could be insert-moulded into the first or second member. A further possibility would be to provide the upper surface of the first member with straight, curved or angled upstanding resilient fins. Alternatively the inner surface of the second member could be provided with straight, curved or angled downwardly projecting resilient fins.

When the cup is in use, the user sucks on the spout 20 and this will now reduce the pressure within the chamber 181 to below the atmospheric pressure. This reduced pressure is communicated through the channel 183 to the part of the resilient member 16 which overlies the chamber 182 and acts as a diaphragm. As the pressure on the opposite side of the diaphragm is maintained at the ambient atmospheric pressure by the hole 101 a net force acts on the closure element 164 in a direction to lift it off the valve seat 184 and permit liquid from the now inverted cup to be sucked out of the cup by flowing first into the chamber 182 and then through channel 183 into the chamber 181 and the spout 20. Because of the large area of the diaphragm exposed to the low pressure compared with the small area of the closure element 164 in contact with the liquid, the suction applied to the spout does not need to be great for the valve to open.

As liquid is sucked out of the cup, air enters through the venting sphincter valve 166 so that drinking from the cup does not become progressively more difficult.

It can thus be seen that the demand valve has an intake port, constituted by the valve seat, a discharge port communicating with the spout and a control port isolated from the interior of the liquid container and communicating with the ambient atmosphere through a hole 101 in the cap, the valve being opened by the pressure differential between the discharge port and the control port.

Various details of the design of described above worthy of special note to ensure that their significance is fully appreciated.

To open the demand valve, the closure element 164 must be moved in the opposite direction to that in which the fluid flows. Therefore the valve cannot be opened by pressure in the cup, only by suction in the spout.

The pressure within the cup does not communicate with any part of the upper surface of the resilient diaphragm so that leakage cannot take place through the venting hole 101.

The latter hole 101 is small so that the diaphragm cannot be touched from the outside of the cup. Exposure of the whole of the diaphragm to atmosphere would allow leakage to occur if the diaphragm is physically depressed from outside the cup. In the described embodiment of the invention, this can only be achieved if a fine object is deliberately poked through the hole 101.

Aside from the components of the valve being separable, which is important for cleaning and sterilisation, the components cannot be reassembled incorrectly. The asymmetrical oval perimeter of all the components ensures that they will only align with one another in one orientation.

It will be understood that in applications to disposable containers and caps the parts would not have to be separable and could be assembled by any form of bonding.

All the components of the cup are large enough to pass 'small-part' regulations.

When one finishes sucking on the spout, there will be some liquid trapped in the spout, in the chamber 182 and in the channel 183. This liquid will not spill because the spout is dimensioned such that air cannot pass down the spout 20 at the same time as liquid is flowing out of it. Nevertheless, it would be possible for this volume of liquid to be shaken out of the cup and it is therefore an important feature of the described design that the volume of liquid downstream of the valve seat can be kept to below 3 ml, even using components that comply with 'small parts' regulation and without the area of any passage between the valve seat and spout being less than 0.9 sq. mm.

The funnel shaped upper surface of rigid component 18 includes a steeply inclined lip around its periphery to limit its proximity to the underside of the diaphragm. This is as to prevent contact between the two and avoids the surface tension effect of a thin layer of liquid trapped between the two, both of which would substantially reduce the effective area of the diaphragm subjected to the suction.

The preferred embodiment of the invention uses only two components in addition to the cap. This not only simplifies the cleaning, but it also minimises manufacturing costs. Furthermore, it is to be noted in this context that each of the three components can be formed in a two part mould and no expensive tooling costs are involved in their manufacture.

In an alternative embodiment of the invention, the hole 101 in the cap is not flush with the reverse side of the diaphragm. Instead, the cap defines a cavity that is connected to the ambient air by a vent hole. In addition to venting the reverse side of the diaphragm to the ambient air, the cavity also serves to vent the interior of the drinking cup, via a valve similar to the sphincter valve 166 described above.

It should be made clear that the invention is not restricted to use in a cup and may be used as a bottle cap or even with flexible walled containers. Furthermore, the cap need not be separable from the container may be permanently built into it, allowing the entire container to be disposable. Further, the spout part could be flexible and have an elongated extension such as a straw.

The invention claimed is:

1. A cap for closing a liquid beverage container, the container having an interior, the cap comprising a hole, a demand valve and a spout; the spout allowing the beverage to be sucked out of the container through the spout, while preventing spillage when no suction takes place; the demand valve comprising a valve inlet port in fluid communication with the container for admitting beverage from within the container into the demand valve, a discharge port in fluid communication with the spout, such that beverage admitted into the demand valve through the valve inlet port is sucked out through the discharge port and out through the spout, and a control port communicating with an ambient atmosphere through the hole in the cap; wherein the demand valve further comprises a valve seat and a valve closure element controlling the flow from the valve inlet port to the discharge port, the valve closure element being urged by a pressure in the container to move in a direction to seal against the valve seat in a closed position, and being urged to move to an open position in dependence on an excess of a pressure in the control port over a pressure in the discharge port; wherein the valve closure element moves to open the demand valve in an opposite direction to a direction of a flow of liquid through the demand valve; wherein the demand valve is formed by first and second members that are mounted on an inner side of the cap, the first member being rigid, having an outer rim, and defining the valve inlet port and the valve seat, and the second member comprising the valve closure element and further comprising a resilient membrane connected to the valve closure element as a pressure sensitive diaphragm, the second member sealing around the hole in the cap, and the second member surrounding and sealing against the entirety of the outer rim of the first member in the closed position of the demand valve.

2. The cap of claim 1, the spout comprising an extension, wherein the second member seals around the extension of the spout.

3. The cap of claim 1, wherein the first and second members are releasably mounted on the inner side of the cap.

4. The cap of claim 3, wherein a rim of the second member is trapped between the cap and the first member.

5. The cap of claim 4, the spout comprising an extension and the second member comprising a resilient ring, wherein the resilient ring is sealingly trapped between the extension of the spout and a surface of the first member.

6. The cap of claim 4, further comprising a recess for receiving the first and second members of the demand valve, the recess comprising a side wall; wherein the second member further comprises a peripheral rim trapped between the first member and the side wall of the recess to retain the first and second members of the demand valve within the recess and effect a seal to isolate the control port from the interior of the container.

7. The cap of claim 1, further comprising biasing means to urge the closure element towards the closed position.

8. The cap of claim 7, wherein the second member is deflected from a first position when the demand valve is closed to the closed position, thereby applying a force for maintaining the closure element against the valve seat.

9. The cap of claim 7, wherein the first member comprises an upper surface, and wherein the upper surface comprises a plurality of resilient upstanding fins to apply a force for maintaining the closure element against the valve seat.

10. The cap of claim 7, wherein the second member comprises an inner surface, and wherein the inner surface comprises a plurality of resilient fins extending downwards from the inner surface of the second member to apply a force for maintaining the closure element against the valve seat.

11. The cap of claim 7, further comprising means for applying a magnetic force to the second member to maintain the closure element against the valve seat.

12. The cap of claim 1, wherein a surface area of the resilient membrane is significantly greater than a surface area of the valve seat.

13. The cap of claim 1, wherein the first member defines a chamber having a conically tapering surface covered at one end by the resilient membrane and terminating at the other in the valve seat and wherein the conical surface has a steeply inclined lip around its periphery to prevent the resilient membrane from contacting the conical surface and reducing the amount of liquid trapped between them by surface tension.

14. The cap of claim 1, further comprising a passage leading from the valve seat to the spout, wherein the passage has a total volume of less than 3 ml.

15. The cap of claim 1, wherein the resilient membrane cannot be touched by hand from outside of the container.

16. The cap of claim 14, wherein the total volume is less than 2 ml.

* * * * *